US009079297B2

(12) United States Patent
Lance et al.

(10) Patent No.: US 9,079,297 B2
(45) Date of Patent: Jul. 14, 2015

(54) FLEX-HEAD WRENCH

(75) Inventors: Christopher Lance, Towson, MD (US); Tim McKenzie, Cockeysville, MD (US)

(73) Assignee: Apex Brands, Inc., Sparks, MD (US)

( * ) Notice: Subject to any disclaimer, the term of this patent is extended or adjusted under 35 U.S.C. 154(b) by 219 days.

(21) Appl. No.: 13/188,830

(22) Filed: Jul. 22, 2011

(65) Prior Publication Data

US 2012/0260775 A1 Oct. 18, 2012

Related U.S. Application Data

(60) Provisional application No. 61/476,123, filed on Apr. 15, 2011.

(51) Int. Cl.

| | |
|---|---|
| ***B25B 13/06*** | (2006.01) |
| ***B25B 13/46*** | (2006.01) |
| ***B25B 23/16*** | (2006.01) |
| ***B25B 13/04*** | (2006.01) |
| ***B25B 13/56*** | (2006.01) |

(52) U.S. Cl.

CPC ..... *B25B 13/04* (2013.01); *B25B 13/46* (2013.01); *B25B 13/56* (2013.01)

(58) Field of Classification Search

CPC ..... B25B 13/04; B25B 13/06; B25B 13/46; B25B 13/461; B25B 13/463; B25B 13/481; B25B 13/56; B25G 1/06; B25G 1/063

USPC ..... 81/57.5, 124.5, 125.1, 177.8, 177.9, 81/177.7, 177.6, DIG. 6, 60

See application file for complete search history.

(56) References Cited

U.S. PATENT DOCUMENTS

| | | | | |
|---|---|---|---|---|
| 65,114 | A * | 5/1867 | Perkins | 81/DIG. 6 |
| 109,665 | A | 11/1870 | Richards | |
| 334,010 | A | 1/1886 | Follett | |
| 460,474 | A | 9/1891 | Knapp et al. | |
| 478,680 | A | 7/1892 | Brendlinger | |
| 485,290 | A | 11/1892 | Miller | |
| D34,540 | S | 5/1901 | Engstrom | |
| 1,155,937 | A | 10/1915 | Lerfald | |
| 1,209,320 | A | 12/1916 | Morneweck | |
| 1,286,506 | A | 12/1918 | Beery | |
| 1,793,714 | A * | 2/1931 | Newberg | 81/125.1 |

(Continued)

FOREIGN PATENT DOCUMENTS

| | | |
|---|---|---|
| CA | 2119396 | 11/1994 |
| CN | 85205504 U | 8/1986 |

(Continued)

OTHER PUBLICATIONS

Taiwan Search Report dated Nov. 27, 2012 for Taiwan Design Application No. 101302651.

(Continued)

*Primary Examiner* — Hadi Shakeri

(74) *Attorney, Agent, or Firm* — Nelson Mullins Riley & Scarborough, LLP

(57) ABSTRACT

A wrench including a handle having a first yoke at a first end and a first plurality of tool heads coupled to the first yoke at a first pivot axis, at least a first tool head of the first plurality of tool heads having a drive cavity. Each tool head of the first plurality of tool heads is pivotable about the first pivot axis independently of the other tool heads of the first plurality of tool heads.

27 Claims, 7 Drawing Sheets

(56) References Cited

U.S. PATENT DOCUMENTS

| | | | | |
|---|---|---|---|---|
| 2,097,361 | A * | 10/1937 | Bagley | 81/177.6 |
| 2,500,835 | A | 3/1950 | Lang | |
| 2,803,980 | A | 8/1957 | Vogel | |
| 3,560,688 | A * | 2/1971 | Bachler | 200/278 |
| 4,581,959 | A | 4/1986 | Troiano | |
| 4,699,030 | A * | 10/1987 | Yang | 81/124.5 |
| 4,711,145 | A | 12/1987 | Inoue | |
| 4,840,094 | A | 6/1989 | Macor | |
| 4,901,608 | A | 2/1990 | Shieh | |
| 5,199,335 | A | 4/1993 | Arnold et al. | |
| 5,272,824 | A | 12/1993 | Cornelius | |
| 5,636,557 | A | 6/1997 | Ma | |
| 5,768,960 | A | 6/1998 | Archuleta | |
| 6,000,302 | A | 12/1999 | Chiang | |
| 6,161,454 | A | 12/2000 | Chaconas | |
| 6,186,034 | B1 | 2/2001 | Lamons | |
| 6,216,567 | B1 | 4/2001 | Hu | |
| 6,220,125 | B1 | 4/2001 | Lan | |
| 6,282,991 | B1 | 9/2001 | Hu | |
| 6,282,992 | B1 | 9/2001 | Hu | |
| 6,295,898 | B1 | 10/2001 | Hsieh | |
| 6,324,947 | B2 | 12/2001 | Jarvis | |
| 6,382,058 | B1 | 5/2002 | Owoc | |
| 6,386,075 | B1 | 5/2002 | Shiao | |
| 6,405,621 | B1 | 6/2002 | Krivec et al. | |
| 6,450,066 | B1 | 9/2002 | Hu | |
| 6,453,779 | B2 | 9/2002 | Hu | |
| 6,729,209 | B1 | 5/2004 | Chen | |
| 6,732,614 | B2 | 5/2004 | Hu | |
| 6,745,650 | B1 | 6/2004 | Chang | |
| 6,792,833 | B2 | 9/2004 | Macor | |
| 6,857,341 | B1 | 2/2005 | Cheng | |
| 6,871,569 | B1 | 3/2005 | Chen | |
| 6,886,429 | B1 | 5/2005 | Lee | |
| 6,895,839 | B1 | 5/2005 | Hsien | |
| 6,918,323 | B2 | 7/2005 | Arnold et al. | |
| 6,918,477 | B2 | 7/2005 | Tuanmu | |
| 6,945,141 | B2 | 9/2005 | Hu | |
| 7,000,507 | B1 | 2/2006 | Lin | |
| 7,036,403 | B2 | 5/2006 | Lin | |
| 7,051,625 | B1 | 5/2006 | Lee | |
| RE39,190 | E * | 7/2006 | Weissert | 384/104 |
| 7,082,862 | B2 | 8/2006 | Lee | |
| 7,197,966 | B1 | 4/2007 | Hsieh | |
| 7,318,366 | B2 | 1/2008 | Lee et al. | |
| 7,424,839 | B2 | 9/2008 | Chiang | |
| 7,975,575 | B2 | 7/2011 | Hu | |
| 8,230,766 | B2 * | 7/2012 | Chang | 81/177.8 |
| 8,955,416 | B1 * | 2/2015 | Ragner | 81/57.5 |
| 2003/0015071 | A1 | 1/2003 | Liao | |
| 2003/0079570 | A1 | 5/2003 | Chen | |
| 2004/0025646 | A1 | 2/2004 | Hsien | |
| 2004/0089111 | A1 | 5/2004 | Hsien | |
| 2005/0051004 | A1 | 3/2005 | Chen | |
| 2005/0274234 | A1 | 12/2005 | Lee | |
| 2007/0017322 | A1 | 1/2007 | Chaconas | |
| 2007/0277652 | A1 | 12/2007 | Tuan-Mu | |
| 2010/0326246 | A1 | 12/2010 | Chang | |
| 2011/0197718 | A1 * | 8/2011 | Meholovitch | 81/124.5 |

FOREIGN PATENT DOCUMENTS

| | | | |
|---|---|---|---|
| CN | 1095001 | | 11/1994 |
| CN | 1493433 | A | 5/2004 |
| CN | 101081495 | A | 12/2007 |
| CN | 201760827 | U | 3/2011 |
| DE | 3023882 | | 4/1989 |
| TW | 484490 | U | 4/2002 |
| TW | 501512 | U | 9/2002 |
| TW | M290084 | U | 5/2006 |
| TW | I268832 | B | 12/2006 |
| TW | D121988 | | 3/2008 |
| TW | D129104 | | 6/2009 |
| TW | I339148 | B | 3/2011 |

OTHER PUBLICATIONS

Response to Office Action dated Sep. 3, 2013 for Canadian Patent Application No. 2,774,598.

Office Action dated Feb. 8, 2014 for Chinese Patent Application No. 201210110620.1.

Office Action dated Apr. 30, 2014 for Japanese Patent Application No. 101113522.

Office Action dated Jun. 18, 2014 for Canadian Patent Application No. 2,774,598.

Second Office Action dated Sep. 24, 2014 for Japanese Patent Application No. 201210110620.1.

Office Action dated Jan. 8, 2014 for Taiwan Patent Application No. 101113522.

Office Action dated Sep. 3, 2013 for Canadian Patent Application No. 2,774,598.

Second Office Action dated Sep. 24, 2014 for Chinese Patent Application No. 201210110620.1.

* cited by examiner

FLEX-HEAD WRENCH

CLAIM OF PRIORITY

This application claims priority to U.S. Provisional Patent Application No. 61/476,123 filed Apr. 15, 2011, the entire disclosure of which is incorporated by reference herein.

FIELD OF THE INVENTION

The present invention relates generally to wrenches. More particularly, the present invention relates to a wrench including a flex-head defining a drive cavity.

BACKGROUND OF THE INVENTION

Wrenches are known that are capable of engaging two different sized fasteners. A ratchet wrench may be, for example, capable of engaging a ⅞ inch fastener with one end of the wrench and a ½ inch fastener at the opposite end of the wrench handle. Thus, the number of wrenches required to insure a user can engage a given number of differently sized fasteners is reduced by half.

As well, wrenches having heads that pivot with respect to the wrench's handle axis ("flex-head" wrenches) for adjusting fasteners in hard to reach locations are known. Existing flex-head wrenches typically include a fastener-engaging head portion that is attached to a handle at a pivot joint so that a user may adjust the angular position of the head portion relative to the handle. As well, flex-head wrenches may include locking mechanisms for securing the head portion in the desired position relative to the handle during use. Often, these flex-head wrenches are not adequately suited for adjusting the angle of the head portion relative to the handle with only one hand. More specifically, when the locking mechanism is disengaged from the head portion to allow for adjustment, the head portion pivots freely about the handle. As such, a user must grasp the head portion with one hand for positioning while operating the locking mechanism with the remaining hand.

SUMMARY OF THE INVENTION

The present invention recognizes and addresses considerations of prior art constructions and methods. One embodiment of the present invention provides a wrench including a handle having a first yoke at a first end and a first plurality of tool heads coupled to the first yoke at a first pivot axis, at least a first tool head of the first plurality of tool heads having a drive cavity. Each tool head of the first plurality of tool heads is pivotable about the first pivot axis independently of the other tool heads of the first plurality of tool heads.

Another embodiment of the present invention provides a wrench including a handle having a first end and a second end, a first plurality of tool heads coupled to the first end of the handle at a pivot axis, at least a first tool head of the first plurality of tool heads defining a drive aperture, a ratchet wheel rotatably received in the drive aperture of the first tool head, the ratchet wheel defining a first drive cavity, and a pawl disposed within the drive aperture of the first tool head, the pawl being operatively coupled to the ratchet wheel. Each tool head of the first plurality of tool heads is pivotable with respect to the other tool heads of the first plurality of tool heads about the pivot axis.

Another embodiment of the present invention provides a wrench including a handle having a yoke defined by a pair of arms at a first end, a tool head including a hub defining a mounting bore, a pivot pin passing through the mounting bore of the tool head and arms of the yoke such that the tool head is pivotably attached to the handle, and a retention mechanism including a recess defined by an inner wall of the mounting bore and a plate spring, the plate spring being disposed in the recess such that it contacts the pivot pin, wherein the plate spring exerts a biasing force on the pivot pin.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
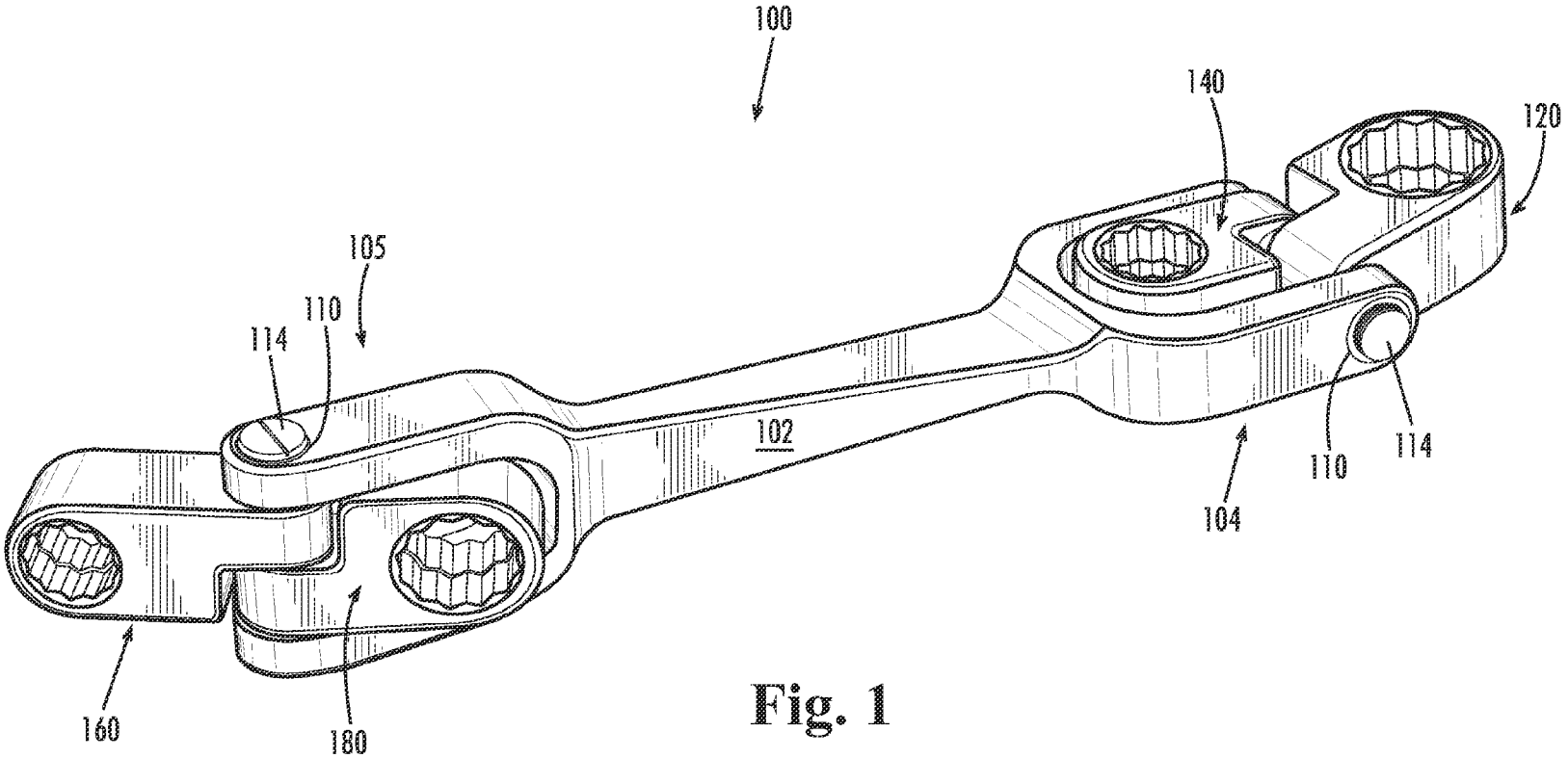
FIG. 1 is a perspective view of a flex-head wrench in accordance with an embodiment of the present invention.
Figures 2A, 2B, 2C:
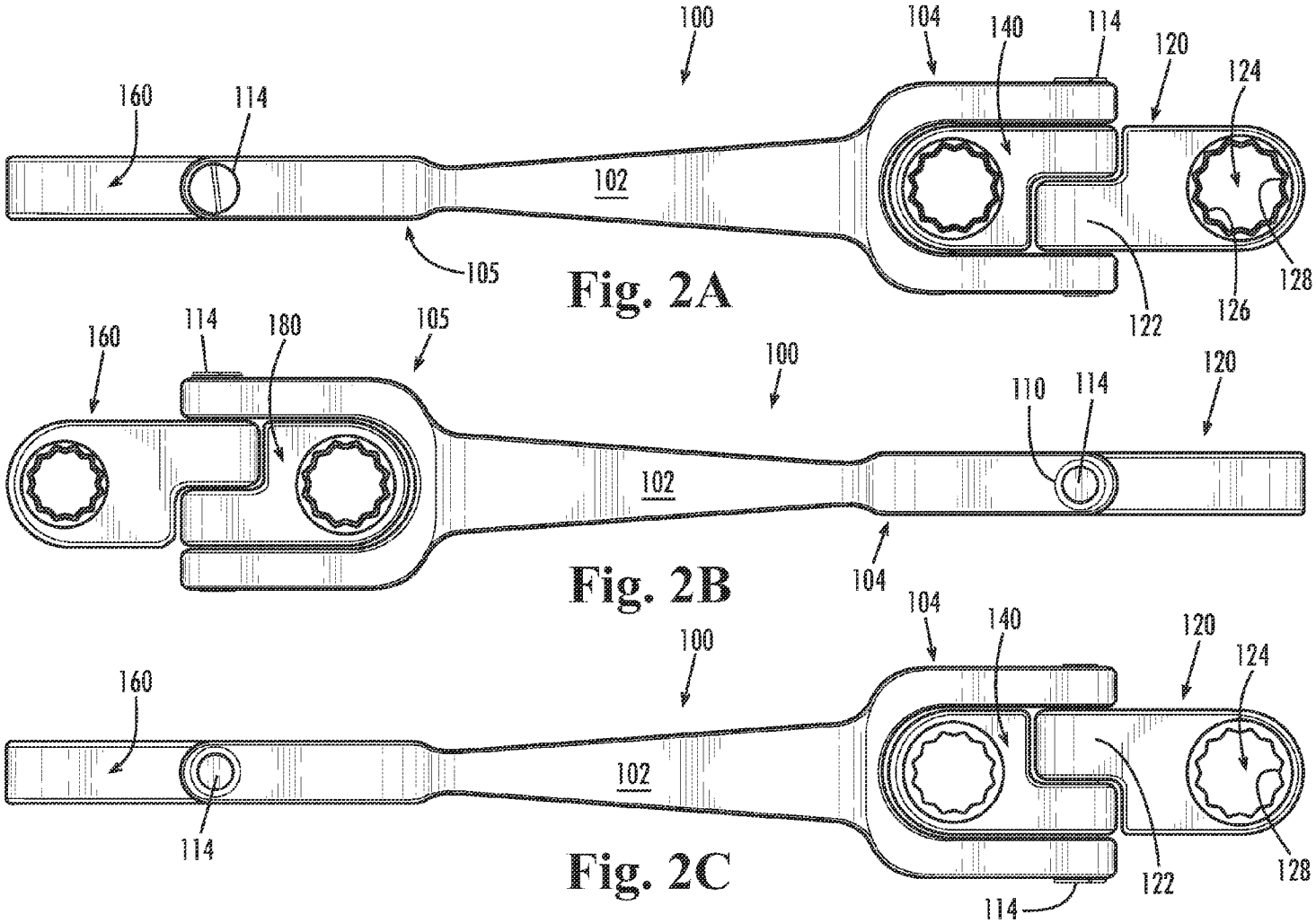
FIGS. 2A, 2B and 2C are top, side and bottom views, respectively, of the flex-head wrench shown in FIG. 1.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to FIGS. 1 through 5D, a flex-head wrench 100 in accordance with the present invention includes at least a first tool head 120 pivotably mounted to a handle 102 such that the angle of first tool head 120 relative to the axis of handle 102 may be selectively altered. Preferably, a retention mechanism 133 maintains the tool head in the desired angular position relative to handle 102. First tool head 120 includes a rearwardly-facing annular hub 122 with a mounting bore 123 formed therein and a through-bore 124 defining at least a first drive cavity 126. As shown, wrench 100 preferably includes a pair of tool heads pivotably mounted on each end of handle 102. More specifically, first tool head 120 and second tool head 140 are mounted to a first end of tool handle 102 and third tool head 160 and fourth tool head 180 are mounted to a second end of handle 102. However, other combinations can include a box wrench head, a ratcheting box wrench head, a standard open wrench head, etc., on the opposite end of the handle 102. The through-bore of each tool head preferably defines a pair of drive cavities for engaging two different sized work pieces, as discussed in greater detail below.

Figures 3A, 3B:
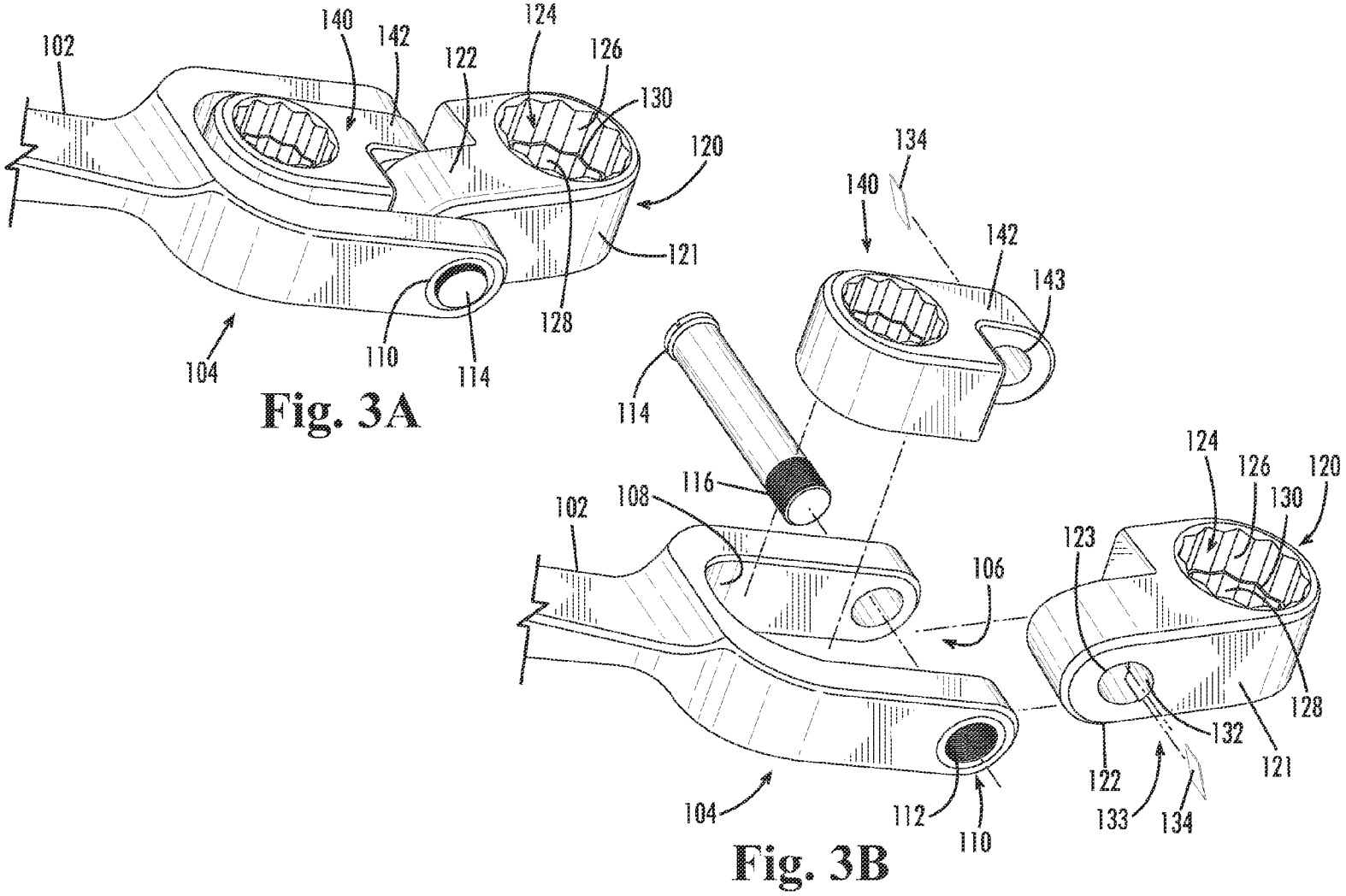
FIGS. 3A and 3B are a partial perspective and an exploded partial perspective view, respectively, of the wrench shown in FIG. 1.
Figure 4A:
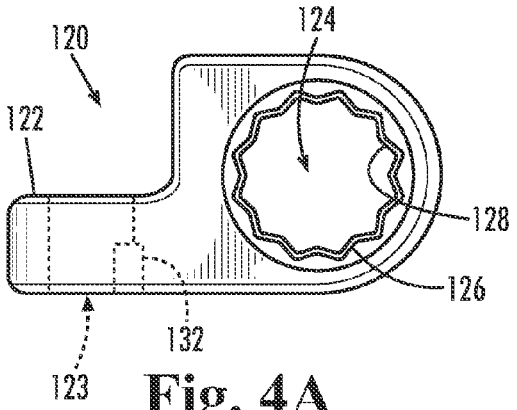
FIGS. 4A, 4B, 4C and 4D are top, bottom, right side and left side views, respectively, of a drive head of the wrench shown in FIG. 1.
Figure 4B:
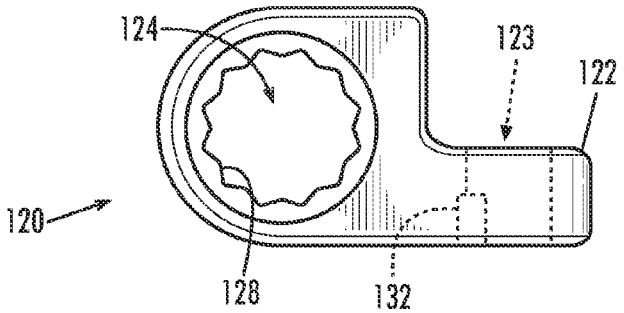
Figure 4C:
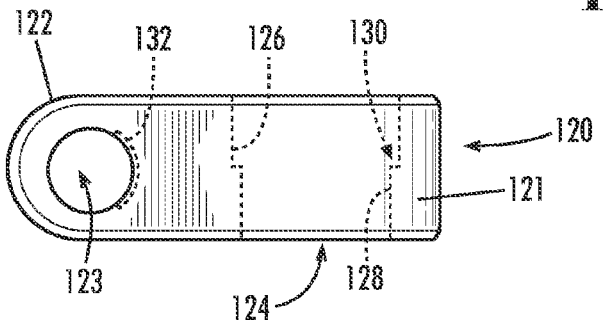
Figure 4D:
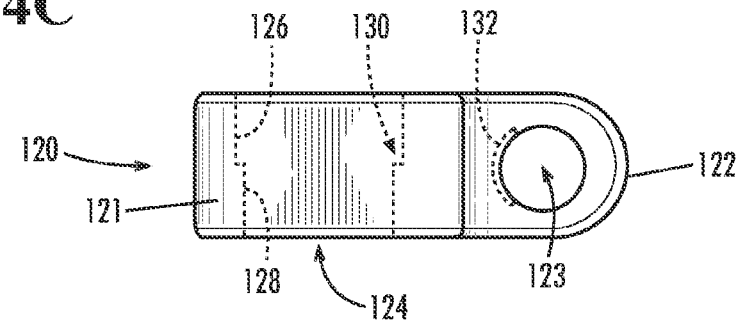
Figure 5A:
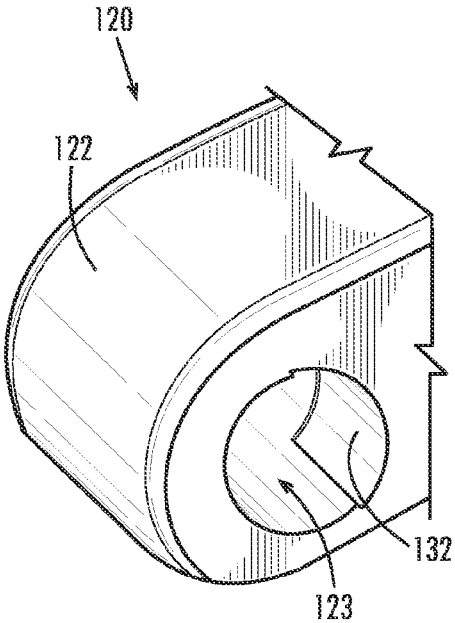
FIGS. 5A through 5D are partial perspective views of a drive head of the wrench shown in FIG. 1.
Figure 5B:
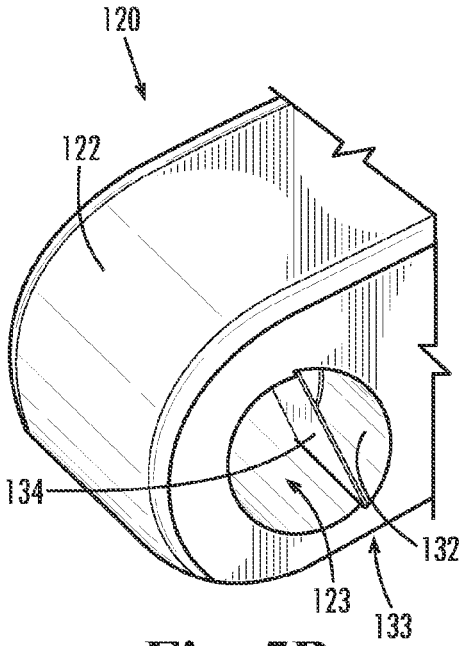
Figure 5C:
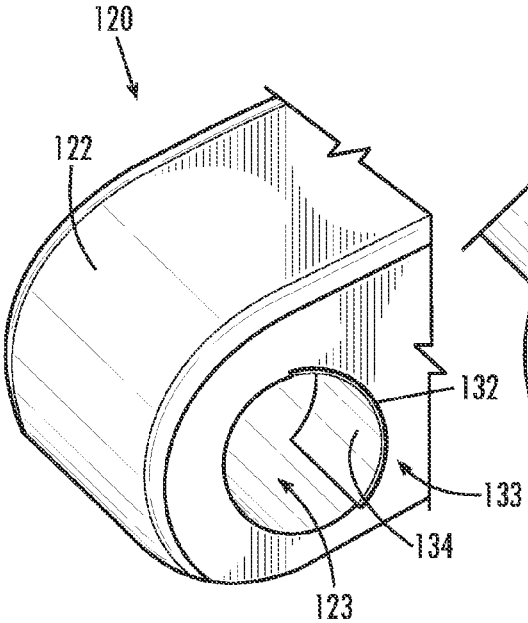
Figure 5D:
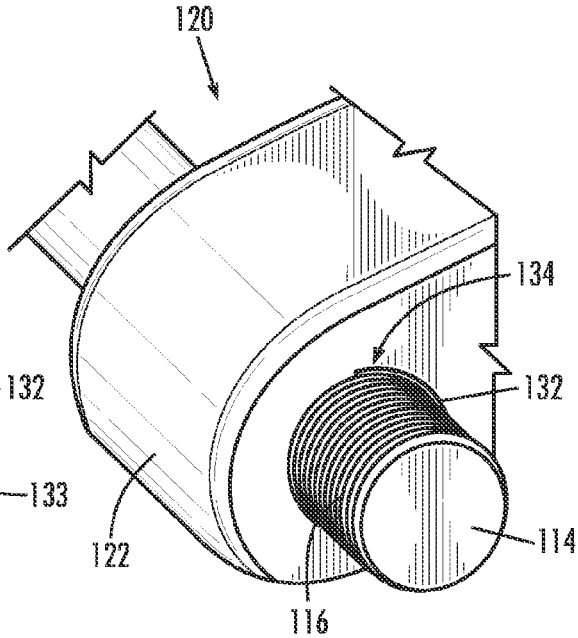

A first yoke 104 and a second yoke 105 are formed by pairs of parallel legs extending from opposite ends of handle 102. Although they are preferably offset relative to each other by 90°, as shown, the configurations of the yokes and corresponding tool heads on opposite ends of wrench 100 are largely identical and, therefore, only first yoke 104 and first and second tool heads 120 and 140 are discussed. As best seen in FIGS. 3A and 3B, an inner wall 108 of first yoke 104 forms a recessed portion 106. Inner wall 108 of first yoke 104 is correspondingly shaped to an outer wall 121 of first tool head 120 such that first tool head 120 is pivotably receivable in recessed portion 106 of first yoke 104. A through-bore 110 is formed through an outer-most end of first yoke 104 so that through-bore 110 aligns with mounting bore 123 of first tool head 120 when annular hub 122 of first tool head 120 is positioned between the legs of first yoke 104. A pivot pin 114 is received in both through-bore 110 of first yoke 104 and mounting bore 123 of first tool head 120 to pivotably secure first tool head 120 to handle 102. Pivot pin 114 includes a threaded end 116 that engages a threaded portion 112 of through-bore 110 to secure the pivot pin therein. Preferably, first tool head 120 is pivotable about pivot pin 114 through 360°.

As best seen in FIGS. 4A through 4D, through-bore 124 of first tool head 120 defines a first drive cavity 126 and a second drive cavity 128 that are in communication with each other such that they are concentric about a longitudinal center axis of through-bore 124. An inner circumference of through-bore 124 at first drive cavity 126 defines a series of spaced apart drive shoulders aligned axially with respect to the center axis of the through-bore. The dimensions of first drive cavity 126 and the drive shoulders are such that the drive shoulders drivingly engage a fastener head of a predetermined size (the diameter across opposing vertical drive shoulders in a cavity such as first drive cavity 126 that defines the size of the fastener the cavity is configured to receive and drive is referred to herein as the "operative diameter"). The operative diameter of first drive cavity 126 is different from the operative diameter of second drive cavity 128, and first drive cavity 126 and second drive cavity 128 can therefore be used to drive fastener heads of two different sizes.

As shown, first and second drive cavities 126 and 128 are contiguous, meaning the cavities as defined by the respective gripping surfaces open into each other in the axial direction without separation by an intermediate structure. Because first and second drive cavities 126 and 128 have different operative diameters so that they may engage different sized fastener heads, a ledge 130 extends outwardly between the contiguous ends of the drive cavities. Ledge 130 acts as an abutment only for those fasteners being engaged by first drive cavity 126 as it is the larger of the two drive cavities.

Referring additionally to FIGS. 5A through 5D, each tool head preferably includes a retention mechanism 133 for maintaining the respective tool head in the desired angular position relative to wrench handle 102. As shown, retention mechanism 133 includes a semi-cylindrical recess 132 defined by the inner wall of the tool head's mounting bore 123 and a plate spring 134 that is configured to be received in the recess. Opposing edges of plate spring 134 are positioned in mounting bore 123 of first tool head 120 such that its opposing top and bottom edges are received by opposing edges of recess 132. When securing first tool head 120 to the wrench handle, plate spring 134 is biased outwardly relative to the longitudinal axis of mounting bore 123 such that it becomes seated, at least partially, within recess 132 as pivot pin 114 is passed through mounting bore 123. As such, plate spring 134 exerts a resultant biasing force inwardly toward the longitudinal axis of mounting bore 123, thereby helping to maintain the angular position of first tool head 120 relative to pivot pin 114 and, therefore, the handle of the wrench. To reposition the tool head relative to the handle, a user merely exerts enough rotational force on the tool head to overcome the biasing force that plate spring 134 exerts on pivot pin 114.

Figure 6A:
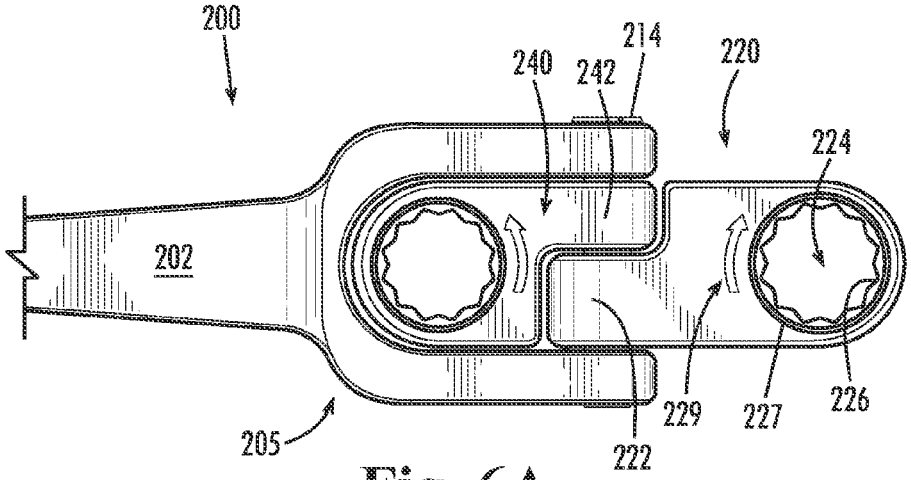
FIGS. 6A and 6B are partial top and bottom views, respectively of an alternate embodiment of a wrench in accordance with the present invention.
Figure 6B:
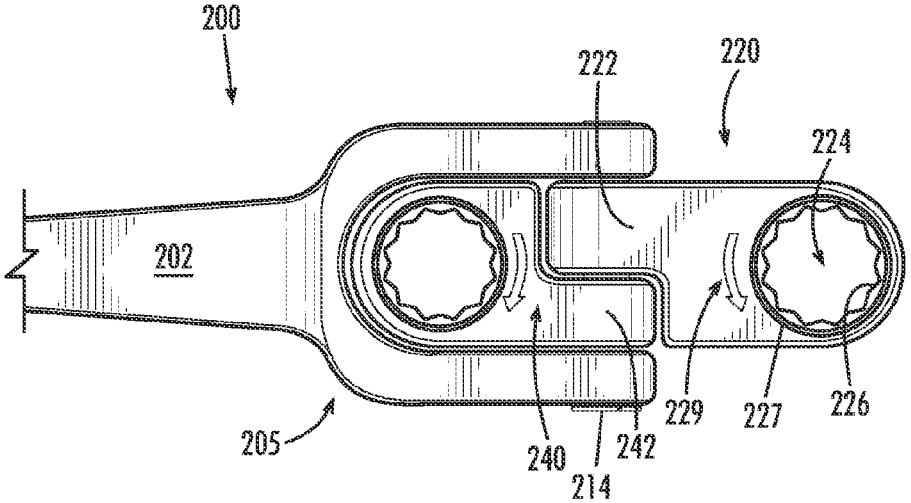

Referring now to FIGS. 6A and 6B, an alternate embodiment of a flex-head wrench 200 is shown in accordance with the present invention. Wrench 200 is constructed similarly to wrench 100 shown in FIGS. 1 through 5D, in that a first tool head 220 and a second tool head 240 are pivotably mounted to a handle 202 by a pivot pin 214 that passes through hubs 222 and 242 of first tool head 220 and second tool head 240, respectively, and a yoke 205 disposed on an end of the handle. However, wrench 200 differs in that each tool head includes a ratchet ring. For example, a ratchet ring 227 is rotatably received in first tool head 220 and includes a through-bore 224 that defines a drive cavity 226 for engaging variously shaped work pieces, fasteners, tools, etc. A ratcheting mechanism (not shown) is disposed within first tool head 220 and engages an outer surface of ratchet ring 227. Embodiments of such ratchet mechanism are disclosed in U.S. Pat. No. 5,636,557 to Ma, issued Jun. 10, 1997, the entire disclosure being incorporated herein by reference. An indicator arrow 229 is disposed on both sides of first tool head 220 adjacent ratchet wheel 227 to indicate in which direction wrench 200 is rotated to apply torque to a corresponding work piece.

Figure 7A:
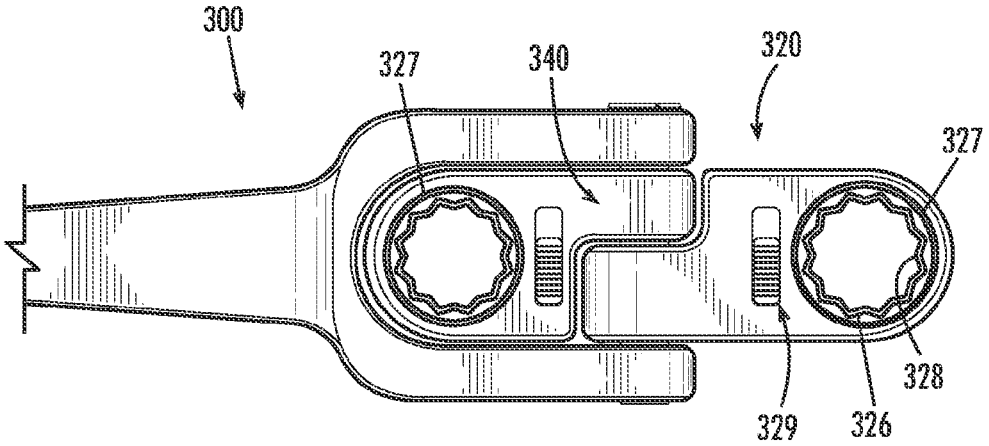
FIGS. 7A and 7B are partial top and bottom views, respectively, of an alternate embodiment of a wrench in accordance with the present invention.
Figure 7B:
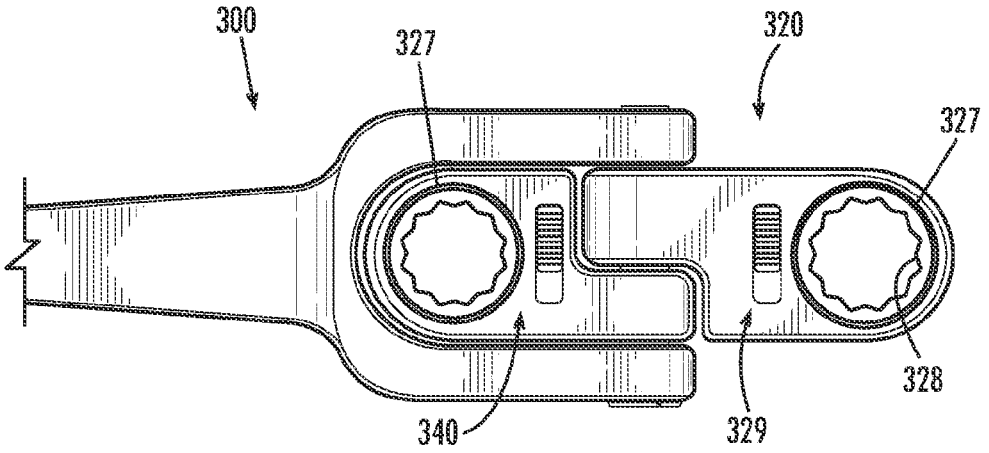

Referring now to FIGS. 7A and 7B, a further embodiment of a flex-head wrench 300 is shown in accordance with the present invention. Wrench 300 is constructed similarly to wrench 200 shown in FIGS. 6A and 6B, with the exception that the ratcheting mechanisms (not shown) disposed within first and second tool heads 320 and 340 are selectively reversible by manipulating a ratchet lever 329. Manipulation of ratchet lever 329 allows the user to select the direction of rotation of wrench 300 that causes torque to be transmitted to a work piece. Embodiments of such ratchet mechanisms are disclosed in U.S. Pat. No. 6,918,323 to Arnold, et al., issued Jul. 19, 2005, the entire disclosure being incorporated herein by reference. Note, the ability to select the direction of rotation to apply torque permits the use of multiple drive cavities within a single ratchet wheel. For example, ratchet wheel 327 of first tool head 320 defines a first drive cavity 326 and a second drive cavity 328, the drive cavities having different operative diameters.

While one or more preferred embodiments of the invention are described above, it should be appreciated by those skilled in the art that various modifications and variations can be made in the present invention without departing from the scope and spirit thereof. For example, the flex-head feature can be used with tool heads having various drive cavity configurations and alternate retention mechanisms. It is intended that the present invention cover such modifications and variations as come within the scope and spirit of the appended claims and their equivalents.

What is claimed is:

1. A wrench, comprising:

a handle having a first yoke at a first end;

a first plurality of tool heads coupled to the first yoke at a first pivot axis, each tool head of the first plurality of tool heads having a drive cavity and a hub defining a mounting bore;

a pivot pin passing through the mounting bores of the first plurality of tool heads and the first yoke so that the first plurality of tool heads is coupled to the first yoke; and a plurality of retention mechanisms, each including a semi-cylindrical recess defined by an inner wall of a respective said mounting bore and a plate spring, the plate spring being disposed in the semi-cylindrical recess so that it contacts the pivot pin, wherein the plate spring exerts a biasing force on the pivot pin in a radial direction with respect to the first pivot axis, wherein each tool head of the first plurality of tool heads is pivotable about the first pivot axis independently of each other tool head of the first plurality of tool heads, and the hubs of the first plurality of tool heads are adjacently positioned on the first pivot axis and each drive cavity is positionable on a longitudinal center axis of the handle passing through a longitudinal center of the first pivot pin.

2. The wrench of claim 1, wherein the first plurality of tool heads further comprises at least a first tool head and a second tool head, wherein the drive cavity of the first tool head further comprises a first drive cavity configured to drivingly engage a workpiece of a first predetermined size and a second drive cavity configured to drivingly engage a workpiece of a second predetermined size, and wherein each of the first and second predetermined sizes is different from each other of the first and second predetermined sizes.

3. The wrench of claim 2, further comprising a ratchet wheel rotatably received in the first tool head, wherein each of the first drive cavity and the second drive cavity are defined by the ratchet wheel.

4. The wrench of claim 3, further comprising a direction control mechanism mounted in the first tool head and movable between a first predetermined position and a second predetermined position such that torque is applicable to the workpiece in either a first rotational direction when the direction control mechanism is in the first predetermined position or a second rotational direction when the direction control mechanism is in the second predetermined position.

5. The wrench of claim 4, further comprising a pawl movably disposed within the first tool head, the pawl being operably coupled to both the ratchet wheel and the direction control mechanism.

6. The wrench of claim 1, further comprising:

a second yoke disposed at a second end of the handle; and a second plurality of tool heads coupled to the second yoke at a second pivot axis, wherein each tool head of the second plurality of tool heads is pivotable about the second pivot axis of the second yoke independently of each other tool head of the second plurality of tool heads.

7. The wrench of claim 6, wherein the first and second yokes are each defined by a pair of arms, the arms of the first yoke lie in a first plane, the arms of the second yoke lie in a second plane, and the first plane is transverse to the second plane.

8. The wrench of claim 1, wherein each tool head of the first plurality of tool heads is fully rotatable through 360° about the first pivot axis of the first yoke.

9. The wrench of claim 1, further comprising a ratchet wheel rotatably received in each tool head, wherein the drive cavity of each tool head is defined by the ratchet wheel received therein.

10. The wrench of claim 1, wherein the drive cavity of each tool head is defined by a through-bore, the through-bore opening to opposite sides of said tool head.

11. A wrench, comprising:

a handle having a first end having a first yoke formed by a pair of arms and a second end;

a first plurality of tool heads coupled to the first end of the handle at a first pivot axis, each tool head of the first plurality of tool heads defining a drive aperture and a hub defining a mounting bore, the hub of each tool head of the first plurality of tool heads being disposed between the arms of the first yoke;

a pivot pin passing through the mounting bores of the first plurality of tool heads and the arms of the first yoke such that the first plurality of tool heads is pivotably attached to the handle; and a plurality of retention mechanisms, each including a semi-cylindrical recess defined by an inner wall of a respective said mounting bore and a plate spring, the plate spring being disposed in the semi-cylindrical recess such that it contacts the pivot pin, the plate spring exerting a biasing force on the pivot pin in a radial direction with respect to the first pivot axis;

a ratchet wheel rotatably received in the drive aperture of each tool head, each ratchet wheel defining a first drive cavity; and a pawl disposed within the drive aperture of each tool head, each pawl being operatively coupled to the ratchet wheel of its drive aperture, wherein each tool head of the first plurality of tool heads is pivotable with respect to each other tool head of the first plurality of tool heads about the first pivot axis, and each drive aperture is positionable along a longitudinal center axis of the handle, and the hubs of the first plurality of tool heads are adjacently positioned on the first pivot axis and each drive cavity is positionable on a longitudinal center axis of the handle passing through a longitudinal center of the first pivot pin.

12. The wrench of claim 11, wherein the first plurality of tool heads comprises at least a first tool head and a second tool head, wherein the first drive cavity of the first tool head is configured to drivingly engage a workpiece of a first predetermined size and the ratchet wheel of the first tool head further comprises a second drive cavity configured to drivingly engage a workpiece of a second predetermined size, and wherein each of the first and second predetermined sizes is different from each other of the first and second predetermined sizes.

13. The wrench of claim 11, further comprising a direction control mechanism mounted in the first tool head and movable between a first predetermined position and a second predetermined position such that torque is applicable to a workpiece in either a first rotational direction when the direction control mechanism is in the first predetermined position or a second rotational direction when the direction control mechanism is in the second predetermined position.

14. The wrench of claim 13, wherein the pawl is operably coupled to the direction control mechanism.

15. The wrench of claim 11, further comprising:

a second yoke disposed at a second end of the handle; and a second plurality of tool heads coupled to the second yoke at a second pivot axis, wherein each tool head of the second plurality of tool heads is pivotable with respect to each other tool head of the second plurality of tool heads about the second pivot axis of the second yoke.

16. The wrench of claim 15, wherein the first pivot axis of the first yoke is transverse to the second pivot axis of the second yoke.

17. The wrench of claim 11, wherein each tool head of the first plurality of tool heads is fully rotatable through 360° about the first pivot axis of the first yoke.

18. A wrench, comprising:

a handle having a first yoke at a first end; and a first plurality of tool heads coupled to the first yoke at a first pivot axis, each tool head of the first plurality of tool heads having a drive cavity and a hub defining a mounting bore;

a pivot pin passing through the mounting bores of the first plurality of tool heads and the first yoke so that the first plurality of tool heads is coupled to the first yoke; and a retention spring associated with the hub of a corresponding tool head and exerting a biasing force on the pivot pin in a radial direction with respect to the first pivot axis so that the spring impedes rotation of the corresponding hub with respect to the handle of the wrench, wherein each tool head of the first plurality of tool heads is pivotable about the first pivot axis independently of each other tool head of the first plurality of tool heads, and the hubs of the first plurality of tool heads are adjacently positioned on the first pivot axis and each drive cavity is positionable on a longitudinal center axis of the handle passing through a longitudinal center of the first pivot pin.

19. The wrench of claim 18, wherein the drive cavity of a first tool head of the first plurality of tool heads further comprises a first drive cavity configured to drivingly engage a workpiece of a first predetermined size and a second drive cavity configured to drivingly engage a workpiece of a second predetermined size, and wherein each of the first and second predetermined sizes is different from each other of the first and second predetermined sizes.

20. The wrench of claim 19, further comprising a ratchet wheel rotatably received in the first tool head, wherein each of the first drive cavity and the second drive cavity are defined by the ratchet wheel.

21. The wrench of claim 20, further comprising a direction control mechanism mounted in the first tool head and movable between a first predetermined position and a second predetermined position such that torque is applicable to the workpiece in either a first rotational direction when the direction control mechanism is in the first predetermined position or a second rotational direction when the direction control mechanism is in the second predetermined position.

22. The wrench of claim 21, further comprising a pawl movably disposed within the first tool head, the pawl being operably coupled to both the ratchet wheel and the direction control mechanism.

23. The wrench of claim 18, further comprising:

a second yoke disposed at a second end of the handle; and a second plurality of tool heads coupled to the second yoke at a second pivot axis, wherein each tool head of the second plurality of tool heads is pivotable about the second pivot axis of the second yoke independently of each other tool head of the second plurality of tool heads.

24. The wrench of claim 23, wherein the first and second yokes are each defined by a pair of arms, the arms of the first yoke lie in a first plane, the arms of the second yoke lie in a second plane, and the first plane is transverse to the second plane.

25. The wrench of claim 18, wherein each tool head of the first plurality of tool heads is fully rotatable through 360° about the first pivot axis of the first yoke.

26. The wrench of claim 18, further comprising a ratchet wheel rotatably received in each tool head, wherein the drive cavity of each tool head is defined by the ratchet wheel received therein.

27. The wrench of claim 18, wherein the drive cavity of the each tool head is defined by a through-bore, the through-bore opening to opposite sides of the said tool head.

* * * * *